US008511097B2

(12) United States Patent
Kobayashi et al.

(10) Patent No.: US 8,511,097 B2
(45) Date of Patent: Aug. 20, 2013

(54) GAS TURBINE COMBUSTOR AND IGNITION METHOD OF IGNITING FUEL MIXTURE IN THE SAME

(75) Inventors: Masayoshi Kobayashi, Urayasu (JP); Hiroyuki Ninomiya, Akashi (JP); Takeo Oda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 1357 days.

(21) Appl. No.: 11/886,257

(22) PCT Filed: Mar. 15, 2006

(86) PCT No.: PCT/JP2006/005145

§ 371 (c)(1),
(2), (4) Date: Nov. 2, 2007

(87) PCT Pub. No.: WO2006/100983

PCT Pub. Date: Sep. 28, 2006

(65) Prior Publication Data

US 2008/0173019 A1 Jul. 24, 2008

(30) Foreign Application Priority Data

Mar. 18, 2005 (JP) ..... 2005-078730

(51) Int. Cl.
*F02C 7/26* (2006.01)

(52) U.S. Cl.
USPC ..... 60/786; 60/740; 431/260

(58) Field of Classification Search
USPC ..... 60/737, 742, 743, 740, 776, 778, 60/790, 39.281, 786, 39.826, 39.827; 431/43, 431/196, 258–266, 287
See application file for complete search history.

(56) References Cited

U.S. PATENT DOCUMENTS 3,306,333 A * 2/1967 Mock ..... 431/264
3,668,869 A 6/1972 De Corso et al.
4,850,194 A 7/1989 Fuglistaller et al.

(Continued)

FOREIGN PATENT DOCUMENTS

DE 101 57 856 A1 7/2003
EP 0 931 980 A1 7/1999

(Continued)

OTHER PUBLICATIONS

European Search Report issued in European Patent Application No. 06729166.6, mailed on Jun. 16, 2010.
Supplementary European Search Report issued Mar. 11, 2011 for Application No. EP 06 72 9166.6.

*Primary Examiner* — Andrew Nguyen
(74) *Attorney, Agent, or Firm* — Oliff & Berridge, PLC

(57) ABSTRACT

A gas turbine combustor burns a fuel mixture at a high combustion efficiency and a low $NO_x$ emission, is simple in construction and exercises improved ignition performance, and an ignition method can efficiently igniting a fuel mixture in the gas turbine combustor. A gas turbine combustor provided with fuel nozzles each having a pilot fuel injection nozzle and a main fuel injection nozzle, and fuel nozzles each having a pilot fuel injection nozzle and a main fuel injection nozzle. The fuel nozzle disposed close to an igniter is provided with a local fuel injection port through which fuel is jetted out from a predetermined position in an air passage in the main fuel injection nozzle to create a combustible fuel mixture zone in the vicinity of the igniter at least while the igniter is in an ignition operation.

3 Claims, 12 Drawing Sheets

(56) References Cited

U.S. PATENT DOCUMENTS

| | | | | |
|---|---|---|---|---|
| 5,088,287 | A | 2/1992 | Shekleton | |
| 5,365,738 | A * | 11/1994 | Etheridge | 60/742 |
| 5,404,711 | A * | 4/1995 | Rajput | 60/39.463 |
| 5,533,329 | A * | 7/1996 | Ohyama et al. | 60/773 |
| 6,186,775 | B1 | 2/2001 | Jansohn et al. | |
| 6,381,964 | B1 * | 5/2002 | Pritchard et al. | 60/746 |
| 6,877,307 | B2 * | 4/2005 | Ryan et al. | 60/39.281 |
| 6,968,699 | B2 * | 11/2005 | Howell et al. | 60/776 |
| 7,117,678 | B2 * | 10/2006 | Sampath et al. | 60/740 |
| 2007/0033947 | A1 | 2/2007 | Rocca | |

FOREIGN PATENT DOCUMENTS

| | | | |
|---|---|---|---|
| EP | 1 389 713 | A1 | 2/2004 |
| IT | T020 040 309 | A1 | 8/2004 |
| JP | B 50-13420 | | 5/1975 |
| JP | U-58-127236 | | 8/1983 |
| JP | U 58-137236 | | 9/1983 |
| JP | U 63-112245 | | 7/1988 |
| JP | A-2000-18051 | | 1/2000 |
| JP | A 2000-018051 | | 1/2000 |
| JP | A 2000-356315 | | 12/2000 |

* cited by examiner

GAS TURBINE COMBUSTOR AND IGNITION METHOD OF IGNITING FUEL MIXTURE IN THE SAME

TECHNICAL FIELD

The present invention relates to a combustor, for industrial gas turbines for aircrafts and power generation, having pilot fuel injection nozzles which delivers the fuel for diffusion combustion at least in a low-output period including an ignition period, and main fuel injection nozzles for delivering the fuel For premixed combustion only while the gas turbine combustor is in an operation in a middle- or a high-output operation mode to reduce $NO_x$, coaxially surrounding the pilot fuel injection nozzles, and to an ignition method capable of effectively igniting a fuel mixture in the combustor.

BACKGROUND ART

Industrial combustors of the diffusion combustion type are used widely for driving gas turbines for aircrafts and power generators. Air flows into the conventional combustor not only through the fuel nozzle and cooling air supply openings formed in a combustor liner, but also through a dilution air supply opening formed on the downstream side of the fuel nozzle. The fuel delivered by the diffusion fuel nozzle is diffused and mixed into part of the air flowed into the combustor, and burns in the combustor. The rest of the air that did not flow through the fuel nozzle and cooling air supply openings, flows through the dilution air supply opening formed in a downstream part of the combustor into the combustor and is used as air for combustion and for diluting a high-temperature gas to reduce the temperature of the gas to a temperature proper for an engine cycle. A fuel mixture prepared by mixing the fuel and air by the fuel nozzle is not uniform. The spatial distribution of the fuel concentration of the fuel mixture is irregular. The fuel spray angle of the fuel injection nozzle and the position of an igniter are determined so as to make a part of the flammable fuel mixture having a high fuel concentration flow near to an igniter so that the fuel mixture can be easily ignited. Thus the combustor is particularly excellent in ignition performance. Blow-off rarely occurs while the combustor is operating in a low-output operation mode and the combustor is excellent also in flame stability.

In the combustor of the diffusion combustion system, there is a high-temperature frame region because the spatial distribution of the fuel concentration of the fuel mixture is irregular. Consequently, $NO_x$ (nitrogen oxide) is produced at a high rate particularly while the combustor is operating in a high-output operation mode. A large amount of $NO_x$ emission is undesirable from the viewpoint of environmental protection and air pollution prevention. The exhaust gas of gas turbine engines need to meet the recent severe environmental criteria.

Flame temperature needs to be lowered to reduce $NO_x$ emission. To lower $NO_x$ emission, uniform mixing of fuel and air and use of a lean fuel mixture determined in connection with a desired level of $NO_x$ emission for combustion are necessary. A gas turbine of the lean premixed combustion system is one of measures to reduce $NO_x$ emission. In the lean premixed combustion system, a lean uniform fuel and air mixture is produced prior to combustion so as to achieve low $NO_x$ emission.

The lean premixed combustion system can achieve low $NO_x$ emission provided that air distribution in the combustor is designed so that the equivalence ratio of a fuel mixture prepared by the fuel nozzle for an operation in a maximum-output operation mode in which $NO_x$ emission increases to a maximum is low. The fuel mixture needs to be so lean that the equivalence ratio is on the order of 0.7 or below for an operation in a maximum-output operation mode. In this case the equivalence ratio of a fuel mixture to be supplied to the combustor of an aircraft gas turbine for a typical idling operation is between about 0.2 and about 0.3. Such a fuel mixture is excessively lean. Under such a condition, it is possible that the low temperature of compressed air supplied to the fuel nozzle and the combustor may cause poor combustion efficiency or blow off. Whereas uniform mixing of a large amount of air and fuel in the fuel nozzle for the lean premixed combustion system is advantageous in reducing $NO_x$ emission during operations in a maximum-output operation mode, the same makes combustion unstable during an operation in a low- or a middle-output operation mode, may possibly cause blow off and reduces combustion efficiency.

Fuel injection nozzles have been developed in recent years to solve problems in the diffusion combustion system and the premixed combustion system. A hybrid fuel injection nozzle is one of those recently developed fuel injection nozzles. The hybrid fuel injection nozzle has, in combination, a pilot fuel injection nozzle for diffusion combustion and a main fuel injection nozzle, for premixed combustion, coaxially surrounding the pilot injection nozzle. The central pilot fuel injection nozzle mixes fuel with a comparatively small amount of air to produce a rich fuel mixture. The outer main fuel injection nozzle mixes fuel with a comparatively large amount of air to produce a lean fuel mixture. The main fuel injection nozzle operates only during operations in a middle- and a high-output operation mode.

In a combustor provided with the hybrid fuel injection nozzle, only the pilot fuel injection nozzle are fuelled during an operation in a low-output operation mode and the fuel delivered by the pilot fuel injection nozzles is mixed with only air passed through the pilot fuel injection nozzles. Thus a comparatively rich fuel mixture is produced locally to improve flame stability and combustion efficiency during an operation in a low-output operation mode. A lean fuel mixture is produced by fuelling both the pilot and the main fuel injection nozzles during an operation in a high output operation mode to stabilize combustion and to reduce $NO_x$ emission. During an operation in a middle-output operation mode, the number of the working main fuel injection nozzles is changed according to the engine output conditions, namely, temperature and pressure at the inlet of the combustor) to use fuel mixtures of equivalence ratios in a proper range in which combustion efficiency is satisfactory and blow off may not occur. When the hybrid fuel injection nozzle is used, the flames can be stabilized in a wide range of engine operations, and $NO_x$ emission can be reduced during an operation in a high-output operation mode.

During an operation in a low-output operation mode, such as an ignition operation or a relight operation, the outer main fuel injection nozzle of the hybrid fuel injection nozzle are not used for fuel injection and air passed through the main fuel injection nozzle forms an air layer in the vicinity of the inside surface of a wall defining a combustion chamber. This air layer obstructs the flow of a fuel mixture produced by the pilot fuel injection nozzle to a region around the igniter. It may be possible for comparatively large fuel drops having high inertia force among fuel drops jetted out by the pilot fuel injection nozzle to penetrate the air layer and to reach the region around the igniter. However, the pilot fuel injection nozzle needs undesirably to inject a large amount of fuel to produce a combustible fuel mixture by mixing fuel into the main air layer. In principle, the pilot fuel injection nozzle is required to produce fine spray to ensure that the exhaust gas produced by combustion has a satisfactory property. Thus it is undesirable to jet large fuel drops capable of penetrating the air layer.

To ignite the fuel mixture delivered by the fuel injection nozzle into the combustion chamber, the igniter needs to discharge high-energy sparks capable of reaching the combustible fuel mixture delivered by the pilot fuel injection nozzle through the air layer formed in the combustion chamber. A combustor intended to solve such an ignition problem is provided with an igniter capable of being moved in a combustion chamber in diametrical directions. Such a combustor is proposed in Patent document 1.

This previously proposed combustor positions the igniter at a diametrically inner position in the combustion chamber during an operation in an ignition such that the tip of the igniter is positioned near the combustible fuel mixture delivered by the pilot fuel injection nozzle to improve ignition performance. After the completion of ignition, the igniter is retracted to a diametrically outer position in the combustion chamber to space the tip of the igniter apart from flames to prevent the breakage of the tip of the igniter and the disturbance of flows resulting from exposure of the igniter to flames.

Patent document 1: JP 2000-18051 A

DISCLOSURE OF THE INVENTION

Problem to be Solved by the Invention

The foregoing combustor provided with the movable igniter moves the tip of the igniter to a position where the tip of the igniter is exposed to a severe atmosphere of the highest temperature and the highest pressure in the engine. Arrangement of an igniter moving mechanism in such a severe atmosphere affects adversely to the reliability. The complicated igniter moving mechanism increases the cost and weight of the combustor. Therefore it is particularly undesirable to use a heavyweight combustor in combination with aircraft engines subject to restrictions on weight.

The present invention has been made in view of the foregoing problems and it is therefore an object of the present invention to provide a gas turbine combustor capable of reducing $NO_x$ emission, of operating at a high combustion efficiency and of achieving efficient ignition at start or reignition by a simple arrangement, and to provide a method of igniting fuel mixture in the gas turbine combustor.

Means for Solving the Problem

A gas turbine combustor in a first aspect of the present invention includes one or plural fuel nozzles each having a pilot fuel injection nozzle for diffusion combustion at least during an operation in a low-output operation mode including an ignition operation, and a main fuel injection nozzle for premixed combustion during an operation in a middle- or a high-output operation mode and coaxially surrounding the pilot injection nozzle; wherein the fuel nozzle or at last one of the plural fuel nozzles is provided with a local fuel injection means for jetting out fuel from a predetermined position in an air passage in the main fuel injection valve to create a combustible fuel mixture zone in the vicinity of an igniter at least while the igniter is in an ignition operation.

In the gas turbine combustor in the first aspect of the present invention, when the igniter operates for starting ignition or for reignition after blow off, a pilot combustible fuel mixture zone created in the combustion chamber by the pilot fuel injection nozzle is surrounded by a main air layer of air passed through the main fuel injection nozzle. The fuel jetted through the local fuel injection port forms a combustible fuel mixture zone extending toward the tip of the igniter in a part of the main air layer. The combustible fuel mixture zone is ignited without fail by the energy of sparks discharged by the igniter to produce a pilot flame, the pilot fame propagates through the combustible fuel mixture zone and, consequently, the combustible fuel mixture in the pilot combustible fuel mixture zone can be surely ignited.

The gas turbine combustor jets a small amount of fuel through the local fuel injection port of the main fuel nozzle during the ignition operation to create the combustible fuel mixture region in the vicinity of the igniter. Thus the ignition performance of the combustor can be improved by jetting a small amount of fuel. Thus the original characteristic effects of the hybrid fuel nozzle, namely, stabilization of flames by the fuel mixture continuously delivered by the pilot fuel injection nozzle for diffusion combustion and reduction of $NO_x$ emission by the use of a lean fuel mixture delivered by the main fuel injection nozzle for premixed combustion, can be effectively exercised, and the improvement of the ignition performance, which has been a problem in the hybrid fuel injection nozzle, can be achieved simply by providing the main fuel injection nozzle with the local fuel injection port.

When the gas turbine combustor in the first aspect of the present invention has a combustor defining an annular combustion chamber, and plural fuel nozzles disposed in a circumferential arrangement in the combustion chamber, it is preferable to provide the local fuel injection port at least in the fuel nozzle disposed close to the igniter. When the pilot combustible fuel mixture zone is ignited through the combustible fuel mixture zone created by the fuel nozzle disposed close to the igniter, a flame in the pilot combustible fuel mixture zone propagates successively to the pilot combustible fuel mixture zones created by the adjacent fuel nozzles. Thus all the fuel nozzles can be surely ignited.

Preferably, the local fuel injection port is disposed on the downstream side of a normal fuel injection port formed in the air passage in the main fuel injection nozzle with respect to an air flow direction. The fuel delivered into the air passage through the local fuel injection port on the downstream side of the normal fuel injection port travels a short distance together with air. Therefore, the fuel delivered through the local fuel injection port flows into the combustion chamber before being mixed with air to produce a lean fuel mixture, flows together with air currents and creates a combustible fuel mixture zone locally extending toward the tip of the igniter in the main air layer. Thus even a small amount of fuel can surely create a combustible fuel mixture zone. Since the fuel delivered through the local fuel injection port, as compared with the fuel delivered through the normal fuel injection port, stays in the air currents for a short time, flash back and self ignition rarely occur.

When the gas turbine combustor is included in a stationary gas turbine engine or the like in which high-pressure air or high-pressure nitrogen gas can be used for fuel purging, the fuel delivered through the local fuel injection port and remaining after the completion of ignition is purged completely by using high-pressure air or nitrogen gas to prevent clogging the local fuel injection port. When the gas turbine combustor is included in an aircraft gas turbine engine or the like in which purging air cannot be use for fuel purging, the local fuel injection port can be prevented from being clogged by continually delivering fuel through the local fuel injection port.

A projection provided with an opening extending toward the igniter may be projected downstream from a downstream end part of a duct included in the pilot fuel injection nozzle instead of providing the fuel nozzle with the local fuel injection port to form combustible local mixture toward the igniter. Fuel reached the opening in the projection flows through the opening in diametrically outward direction and is mixed with a part of air delivered into the combustion chamber through a duct included in the main fuel injection nozzle to produce a combustible fuel mixture. This combustible fuel mixture flows together with air currents toward the tip of the igniter to create a locally extending combustible fuel mixture zone. Thus the fuel delivered by the pilot fuel injection nozzle during an operation in a low-output operation mode including an ignition operation can surely create the combustible fuel mixture zone in the combustion chamber.

Preferably, a guide groove for guiding fuel toward the igniter is formed in the downstream end part of the duct of the pilot fuel injection nozzle so as to be continuous with the opening when the projection provided with the opening is formed on the duct of the pilot fuel injection nozzle. The guide groove guides fuel to prevent the dispersion of fuel being carried outward in the combustion chamber by air currents after reaching the downstream end of the projection. Thus the small amount of fuel delivered by the pilot fuel injection nozzle can create a combustible fuel mixture zone having a predetermined fuel concentration.

A gas turbine combustor in a second aspect of the present invention includes: a combustor defining an annular combustion chamber; plural fuel nozzles disposed in a circumferential arrangement in the combustion chamber; and an igniter; wherein each of the fuel nozzles has a pilot fuel injection nozzle working for diffusion combustion at least during an operation in a low-output operation mode including an ignition operation, and a main fuel injection nozzle for premixed combustion during operations in a middle- and a high-output operation mode and coaxially arranged around the pilot injection valve; and each of the fuel nozzles excluding those disposed close to the igniter is provided with a local fuel injection port for jetting fuel from a predetermined position in an air passage through which air passed through the main fuel injection valves flows to create a combustible fuel mixture zone extending toward the adjacent fuel nozzle on the side of the igniter at least while the igniter is in an ignition operation. When fuel delivered by the fuel nozzles disposed close to the igniter is ignited and burns, flames of the burning fuel ignites the combustible fuel mixture zones extending from the adjacent fuel nozzles. Thus flame propagation characteristic can be remarkably improved.

In the gas turbine combustor in the second aspect of the present invention, a projection provided with an opening through which fuel is jetted out toward the adjacent fuel nozzle may be projected downstream from a downstream end part of a duct included in a pilot fuel injection nozzle included in the fuel nozzle not disposed close to the igniter instead of providing the fuel nozzle with the local fuel injection port. Fuel delivered by the pilot fuel injection nozzle, which delivers fuel during an operation in a low-output operation mode including an ignition operation, of the fuel nozzle other than those disposed close to the igniter can surely create the combustible fuel mixture zone extending toward the adjacent fuel nozzles in the combustion chamber.

Preferably, a guide groove for guiding fuel toward the adjacent fuel nozzle is formed in the downstream end part of the duct of the pilot fuel injection nozzle so as to be continuous with the opening when the projection provided with the opening is formed on the duct of the pilot fuel injection nozzle. The guide groove guides fuel to prevent the dispersion of fuel being carried outward in the combustion chamber by air currents after reaching the tip of the projection. Thus the small amount of fuel delivered by the pilot fuel injection nozzle can create a combustible fuel mixture zone having a predetermined fuel concentration.

A gas turbine combustor in a third aspect of the present invention includes: a combustion cylinder defining an annular combustion chamber; plural fuel nozzles disposed in a circumferential arrangement in the combustion chamber; and an igniter; wherein each of at least the fuel nozzles disposed close to the igniter has a normal fuel injection part, an auxiliary air passage surrounding the fuel injection part, and a local fuel injection port for injecting fuel into the auxiliary air passage at least while the igniter is in an ignition operation to produce a combustible fuel mixture in the vicinity of the igniter.

In a gas turbine combustor in which the staging control of fuel injection according to the variation of engine output is not executed, fuel jetted out through the local fuel injection port of the fuel nozzle disposed close to the igniter into the air passage can create a rich local combustible fuel mixture zone while the igniter is in a starting ignition operation or in a reignition operation after blow off. The combustible fuel mixture zone is ignited by the energy of sparks discharged by the igniter to produce a pilot flame, the pilot flame produced by the combustion of the combustible fuel mixture in the combustible fuel mixture zone propagates through the combustible fuel mixture zone created by the adjacent fuel nozzle and, consequently, combustible fuel mixtures produced by all the fuel nozzles can be surely ignited.

An ignition method of igniting a fuel mixture in a gas turbine combustor including a fuel nozzle having a pilot fuel injection nozzle for diffusion combustion at least during an operation in a low-output operation mode including an ignition operation, and a main fuel injection nozzle for premixed combustion during operations in a middle- and a high-output operation mode and coaxially surrounding the pilot injection nozzle in a fourth aspect of the present invention includes creating a combustible fuel mixture zone around an igniter by jetting fuel through a local fuel injection port opening in a predetermined part of an air passage in each of the main fuel injection nozzle at least while the igniter is in an ignition operation. Fuel is jetted through the local fuel injection port into the air passage forms a local combustible fuel mixture zone extending toward the tip of the igniter in a main air layer. The combustible fuel mixture zone can be surely ignited by the energy of sparks discharged by the igniter. A flame of the burning combustible fuel mixture zone propagates through and can surely ignite a pilot combustible fuel mixture zone.

An ignition method of igniting a fuel mixture in a gas turbine combustor including a combustor defining an annular combustion chamber, plural fuel nozzles disposed in a circumferential arrangement in the combustion chamber, and an igniter, wherein each of the fuel nozzles has a pilot fuel injection nozzle for diffusion combustion at least during an operation in a low-output operation mode including an ignition operation, and main fuel injection nozzle for premixed combustion during operations in a middle- and a high-output operation mode and coaxially arranged around the pilot injection nozzle, and each of the fuel nozzles excluding those disposed close to the igniter is provided with a local fuel injection port for jetting fuel from a predetermined position in an air passage in the main fuel injection nozzles; including creating a combustible fuel mixture zone extending toward the adjacent fuel nozzle on the side of the igniter by jetting fuel through the local fuel injection port at least while the igniter is in an ignition operation. When fuel delivered by the fuel nozzles disposed close to the igniter is ignited and burns, flames of the burning fuel ignites the combustible fuel mixture zones extending from the adjacent fuel nozzles. Thus flame propagation characteristic can be remarkably improved.

An ignition method of igniting a fuel mixture in a gas turbine combustor including a combustion cylinder defining an annular combustion chamber, plural fuel nozzles disposed in a circumferential arrangement in the combustion chamber, and an igniter, wherein each of at least the fuel nozzles disposed close to the igniter is provided with a local fuel injection port through which fuel is injected into an auxiliary air passage surrounding a normal fuel injection part includes creating a combustible fuel mixture zone extending toward the igniter by jetting fuel through the local fuel injection port at least while the igniter is in an ignition operation. In a gas turbine combustor in which the staging control of fuel injection according to the variation of engine output is not executed, fuel jetted out through the local fuel injection port of the fuel nozzle disposed close to the igniter into the auxiliary air passage can create a rich local combustible fuel mixture zone while the igniter is in a starting ignition operation or in a reignition operation after blow off. The combustible fuel mixture zone is ignited by the energy of sparks discharged by the igniter to produce a pilot flame, the pilot flame produced by the combustion of the combustible fuel mixture in the combustible fuel mixture zone propagates through the combustible fuel mixture zone created by the adjacent fuel nozzle and, consequently, combustible fuel mixtures produced by all the fuel nozzles can be surely ignited.

Effect of the Invention

The present invention improves ignition performance by forming the combustible fuel mixture zone extending toward the igniter or toward the adjacent fuel nozzle disposed close to the igniter.

REFERENCE CHARACTERS

Figure 1:
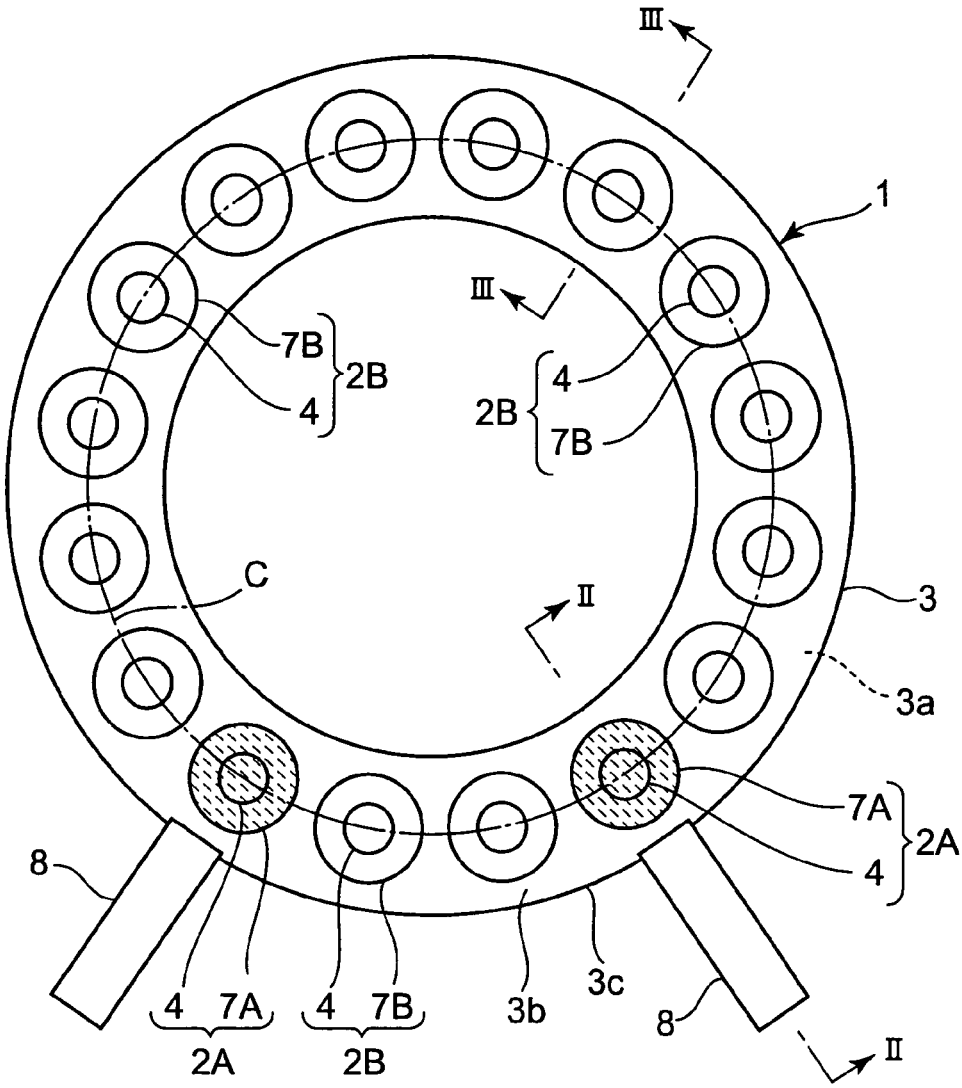
FIG. 1 is a schematic front view of a gas turbine combustor in a first embodiment according to the present invention.

1, 30 and 37: Gas turbine combustors
2A to 2D, 38A and 38B: Fuel nozzles
3: Combustor
3*a*: Combustion chamber
4: Pilot fuel injection nozzle
7A and 7B: Main fuel injection nozzle
8: Igniter
12*a*: Fuel injection port
13: annular air duct (Duct included in the pilot fuel injection nozzle
18*a*: Normal fuel injection port
19*a*: Local fuel injection port
24: Premixing passage (Air passage in the main fuel injection nozzle
31: Projection
32: Opening
34: Guide member
34: Guide groove
47: Normal fuel injection port (Normally used fuel injection part
49: Auxiliary air passage
52*a*: local fuel injection port.
S3, S4, S6 and S8: Combustible fuel mixture zones

BEST MODE FOR CARRYING OUT THE INVENTION

Preferred embodiments of the present invention will be described with reference to the accompanying drawings.

FIG. 1 shows a head unit of a gas turbine combustor 1 in a first embodiment according to the present invention. The gas turbine combustor 1 burns a fuel mixture produced by mixing fuel in compressed air supplied from a compressor included in a gas turbine, not shown, to produce a high-temperature, high-pressure combustion gas and sends the high-temperature, high-pressure combustion gas to the turbine to drive the turbine. The gas turbine combustor 1 is a combustor of the annular type provided with plural fuel nozzles 2A and 2B arranged on a circle.

The gas turbine combustor 1 is an annular combustor 3 defining a combustion chamber 3*a* and having an end wall 3*b*. The fuel nozzles 2A and 2B, namely, fuel supply devices for supplying fuel into the combustion chamber 3*a*, are disposed on the end wall 3*b* of the combustor 3 on a circle C concentric with the combustion cylinder 3. The combustor 3 has an outer wall 3*c*. Two igniters 8 are attached to the outer wall 3*c*. The igniters 8 are separated from each other by an angular space of about 90° and have axes aligned with diameters of the combustor 3, respectively. The gas turbine combustor 1 may be provided with one igniter 8 or three or more igniters 8. The two ignition fuel nozzles 2A are disposed close to the tips of the igniters 8, respectively. The difference between the ignition fuel nozzles 2A and the normal fuel nozzles 2B will be described later. In FIG. 1, the respective axes of the igniters 8 pass the respective centers of the ignition fuel nozzle 2A, respectively. However, the igniters 8 do not need necessarily to be disposed with their axes passing the centers of ignition fuel nozzles 2A if the igniters 8 interfere with other parts when the igniters 8 are disposed with their axes passing the centers of the ignition fuel nozzles 2A.

Each of the ignition fuel nozzles 2A has a pilot fuel injection nozzle 4 and a main fuel injection nozzle 7A coaxially surrounding the pilot fuel injection valve 4, and each of the normal fuel nozzles 2B has a pilot fuel injection nozzle 4 and a main fuel injection nozzle 7B coaxially surrounding the pilot fuel injection nozzle 4. The pilot fuel injection nozzles 4 jet fuel for diffusion combustion during operations in all output operation modes. The main fuel injection nozzles 7*a* and 7B jet out fuel to produce a lean fuel mixture for premixed combustion during operations in a middle- and a high-output operation mode. The pilot fuel injection nozzles 4 spray fuel into the combustion chamber 3*a* such that the fuel is dispersed in the combustion chamber 3*a*. The main fuel injection nozzles 7A and 7B produce a premixed, lean fuel mixture and supply the premixed, lean fuel mixture into the combustion chamber 3*a*.

Figure 2:
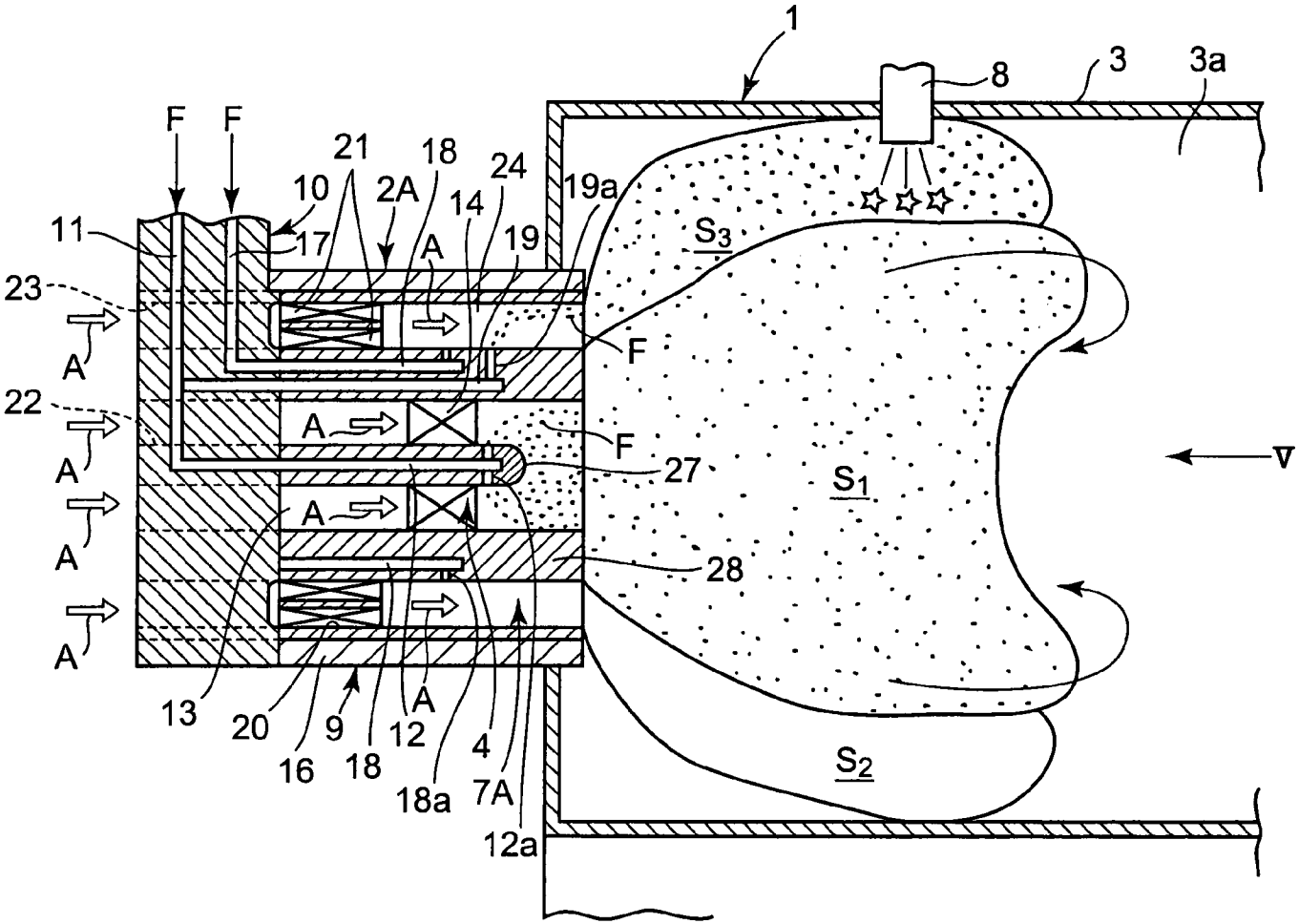
FIG. 2 is an enlarged longitudinal sectional view taken on the line II-II in FIG. 1.

FIG. 2 is an enlarged longitudinal sectional view taken on the line II-II in FIG. 1. FIG. 2 shows the respective positions of the pilot fuel injection nozzle 4 and the main fuel injection nozzle 7A of the ignition fuel nozzle 2A, and the igniter 8 relative to the combustor 3. As shown in FIG. 2, the ignition fuel nozzle 2A has a nozzle body 9, a stem 10 holding the nozzle body 9 on a combustor housing (an outer cylinder), not shown.

The pilot fuel injection nozzle 4 is disposed in a central part of the ignition fuel nozzle 2A. The pilot fuel injection nozzle 4 has a fuel supply passage 11 formed in the stem 10 to supply fuel F from an external fuel source, a fuel supply passage 12 formed in a bar-like central member 27 aligned with the axis of the nozzle body 9 and connected to the fuel supply passage 11, and an annular air duct 13 surrounding the fuel supply passage 12. Compressed air A supplied from the compressor flows through air passages 22 formed in the stem 10 into the annular air duct 13. A swirler 14 for swirling air currents is disposed at a substantially middle part with respect to a direction parallel to the axis of the annular air duct 13. Plural fuel injection ports 12*a* are formed at equal angular intervals in a part of the central member 27 on the downstream side of the swirler 14 and on the upstream side of the downstream end of the annular air duct 13. The fuel injection ports 12*a* are connected to the fuel supply passage 12 and opens into the annular air duct 13. The fuel F delivered through the fuel injection ports 12*a* into the annular air duct 13 is mixed into the air currents A caused to swirl by the swirler 14 and flows together with the swirling air currents A into the combustion chamber 3*a*.

The pilot fuel injection nozzle 4 is surrounded by the main fuel injection nozzle 7A. The pilot fuel injection nozzle 4 and the main fuel injection nozzle 7A are separated by an annular partition wall 28. The main fuel injection nozzle 7A has a fuel supply passage 17 formed in the stem 10 to carry the fuel F supplied from an external fuel source, fuel supply passages 18 formed parallel to the nozzle body 9 in the partition wall 28 and connected to the fuel supply passage 17, a local fuel supply passage 19 formed in the nozzle body 9 and connected to the fuel supply passage 11 of the pilot fuel injection nozzle 4, and an annular air duct 20 coaxial with the annular air duct 13 of the pilot fuel injection nozzle 4, surrounding the fuel supply passage 18 and the local fuel supply passage 19. Air A flows through the air supply passage 23 formed in the stem 10 into the annular air duct 20.

A single or a two swirlers 21 are disposed in the outer annular air duct 20. In the first embodiment shown in FIG. 2, two swirlers 21 forming a double swirler are disposed in the outer annular air duct 20. A premixing passage 24 extends in the annular air duct 20 on the downstream side of the swirlers 21. Air A and the fuel F are mixed uniformly to produce a lean fuel mixture in the premixing passage 24. Plural normal fuel injection ports 18*a* are formed at angular intervals in the partition wall 28 so as to open into a region in the premixing passage 24 on the downstream side of the swirlers 21 disposed in the premixing passage 24. The normal fuel injection ports 18*a* are connected to the fuel supply passage 18. Fuel is jetted out through the normal fuel injection ports 18*a* during operations in a middle- and a high-output operation mode to reduce $NO_x$ emission. One or plural local fuel injection ports 19*a* are formed in the partition wall 28 so as to open into the premixing passage 24. The local fuel injection ports 19*a* are nearer to the igniter 8 than the normal fuel injection ports 18*a*. The local fuel injection ports are disconnected form the normal fuel injection ports 18*a* and are connected to the local fuel supply passage 19.

The fuel F is injected into the premixing passage 24 through the normal fuel injection ports 18*a* during operations in a middle- and a high-output operation mode and is mixed uniformly in swirling air A caused to swirl by the swirlers 21 disposed in the annular air duct 20 to produce a lean premixed fuel mixture. The premixed fuel mixture flows into the combustion chamber 3*a*. During an ignition operation, the fuel F is not jetted out through the normal fuel injection port 18*a* and is injected through the local fuel injection ports 19*a* into the premixing passage 24. The fuel nozzle 2A disposed close to the igniter 8 injects the fuel F through the local fuel injection ports 19*a* into a predetermined region in the premixing passage 24, namely, an air passage in the main fuel injection nozzle 7A.

The fuel F jetted out through the local fuel injection ports 19*a* is mixed in swirling air A caused to swirl as it flows through the swirlers 21 of the annular air duct 20 in regions around the local fuel injection ports 19*a* to produce a local combustible fuel mixture. In this embodiment, the local fuel injection ports 19*a* are formed at optimum axial and circumferential positions determined taking into consideration the velocity of air in the premixing passage 24, which will be described later. Although the local fuel supply passage 19 is formed in the partition wall 28, the local fuel supply passage 19 may be formed if a shroud 16 surrounding the premixing passage 24, and the local fuel injection ports 19*a* may be formed so as to inject the fuel F into regions at predetermined position in the premixing passage 24 from the shroud 16.

Figure 3:
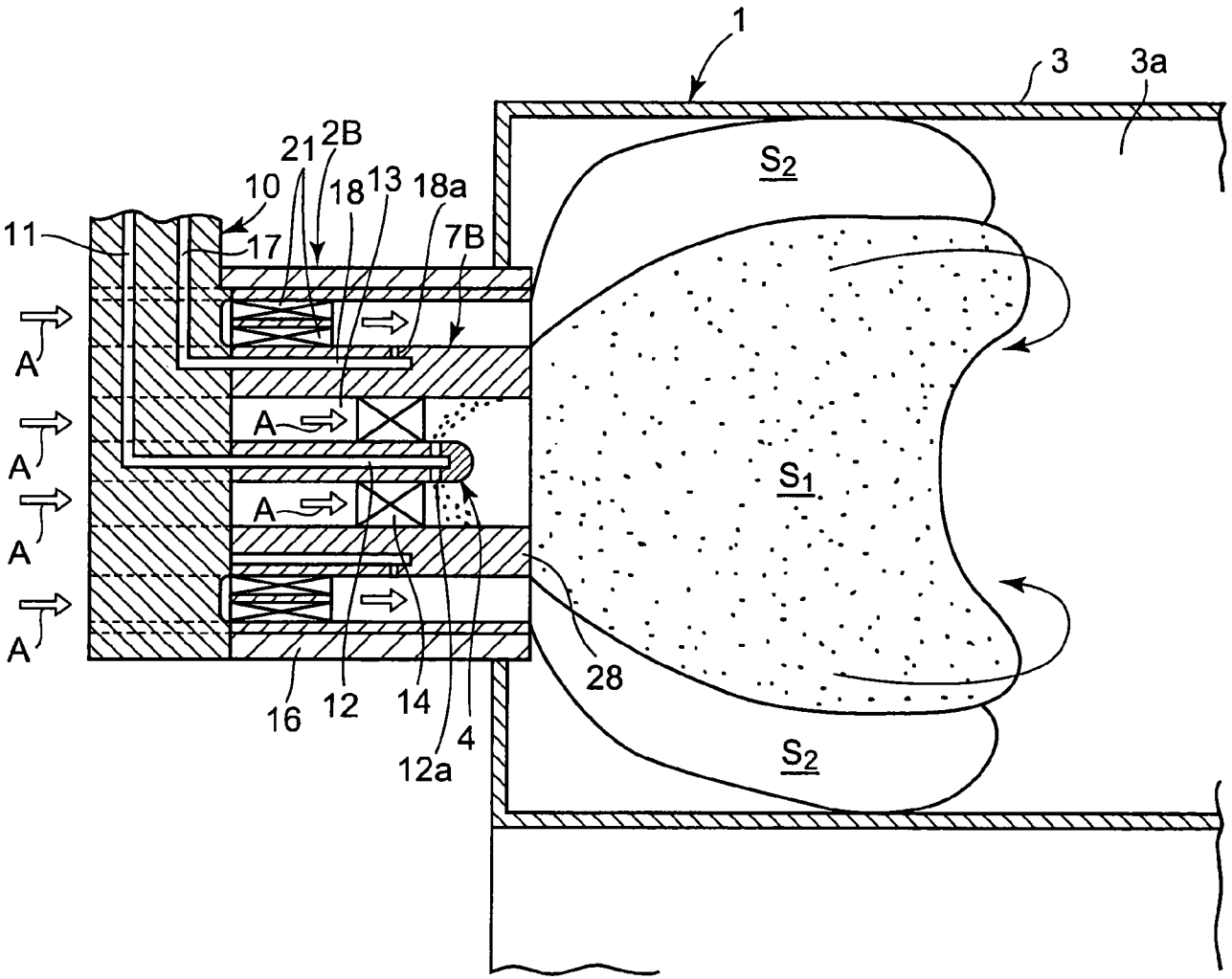
FIG. 3 an enlarged longitudinal sectional view taken on the line III-III in FIG. 1.

As shown in FIG. 3, the normal fuel nozzle 2B is similar in construction to the ignition fuel nozzle 2A, except that the main fuel injection nozzle 7B of the normal fuel nozzle 2B does not have any passage and any injection ports respectively corresponding to the local fuel supply passage 19 and the local fuel injection ports 19*a* of the ignition fuel nozzle 2A. The pilot fuel injection nozzle 4 of the normal fuel nozzle 2B is identical with that of the ignition fuel nozzle 2*a*.

The pilot fuel injection nozzles 4 and the main fuel injection nozzles 7A and 7B mentioned above are only examples and the structure thereof is not limited to that mentioned above. According to the present invention, the term "pilot fuel injection nozzle" is the general designation of fuel injection nozzles coaxially disposed inside the main fuel injection nozzle to jet out the fuel only during an operation in a low-output mode or during operations in all output modes including a low-output mode for maintaining efficient combustion and for stabilizing flames during an operation in a low-output mode. According to the present invention, the term "main fuel injection nozzle" is the general designation of fuel injection nozzles disposed so as to surround the pilot fuel injection nozzle 4 coaxially, separated from the pilot fuel injection nozzle 4 by the annular partition wall 28 to jet out the fuel during operations in a middle- and a high-output mode for a lean-burn operation to reduce $NO_x$ emission.

Figure 4:
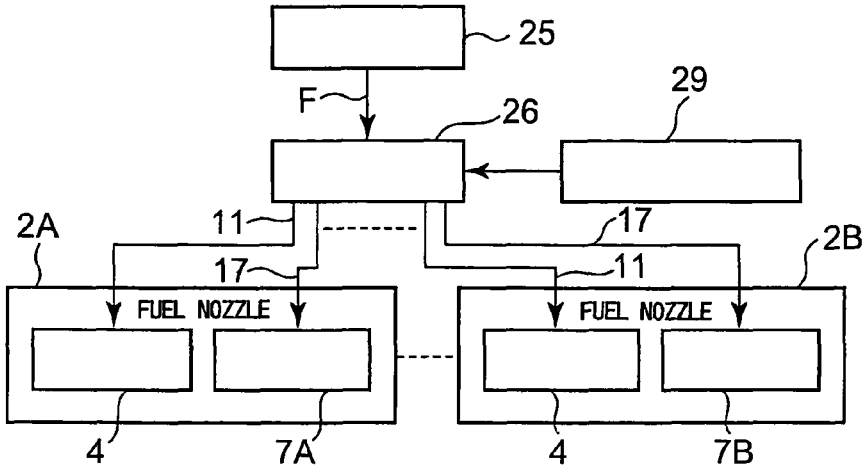
FIG. 4 is a block diagram of a fuel supply system included in the gas turbine combustor in the first embodiment.

FIG. 4 is a block diagram of a fuel supply system included in the gas turbine combustor 1. A fuel regulator 26 includes plural three-way solenoid valves for selectively supplying the fuel F to the pilot fuel injection nozzles 4 and the main fuel injection nozzles 7A and 7B of the fuel nozzles 2A and 2B, and plural fuel control valves for selectively supplying the fuel F to the selected pilot fuel injection valves 4 and the selected main fuel injection valves 7A and 7B at set flow rates dependent on the openings thereof adjusted by actuators, respectively. A fuel controller 29 controls the three-way solenoid valves of the fuel regulator 26 according to load on the gas turbine engine.

Operations of the fuel supply system for controlling the supply of the Fuel F will be described. During an operation in a low-output mode, such as a starting ignition operation or a reignition operation, the fuel F is supplied from a fuel tank 25 at a predetermined flow rate through the fuel supply passages 11 only to the pilot fuel injection ports 4 of the fuel nozzles 2A and 2B. During operations in a middle- and a high-output mode, the fuel F is supplied from the fuel tank 25 at a predetermined flow rate through the fuel supply passages 17 to the fuel injection nozzles 7A and 7B in addition to supplying the fuel F through the fuel supply passages 11 to the pilot fuel injection nozzles 4. Compressed air A is supplied continuously into the air passages 22 and 23 shown in FIG. 2 regardless of load on the gas turbine. The compressed air A is supplied at a comparatively low flow rate to the pilot fuel injection nozzles 4 and the compressed air A is supplied at a comparatively high flow rate to the main fuel injection nozzles 7A and 7B.

Operations of the gas turbine combustor 1 will be described. The fuel controller 29 shown in FIG. 4 controls the valve position of the three-way solenoid valves to supply the fuel F only to the fuel supply passages 11 connected to the pilot fuel injection nozzles 4 of the fuel nozzles 2A and 2B during an ignition operation to start the gas turbine. As shown in FIG. 3, the fuel F supplied to the fuel supply passages 11 flows through the fuel supply passages 12 and is injected through the fuel injection ports 12*a* into spaces defined by the annular air ducts 13. Then, the fuel F is dispersed in the swirling air currents passed through the swirlers 14 and flows together with the swirling air currents into the combustion chamber 3*a* and crates a pilot combustible fuel mixture zone S1 in the combustion chamber 3*a*. The pilot combustible fuel mixture zone S1 is covered with a main air layer S2 of the air A flowed through annular air duct 20 of the main fuel injection nozzle 7A and the premixing passage 24 into the combustion chamber 3*a*.

Part of the fuel F supplied into the fuel supply passage 11 of the pilot fuel injection nozzle 4 of the hybrid ignition fuel nozzle 2A disposed close to the tip of the igniter 8 as shown in FIG. 2 flows through the fuel supply passage 19 and is injected through the local fuel injection pore 19*a* into the premixing passage 24. Since the local fuel injection port 19*a* is on the downstream side of the normal fuel injection ports 18*a* of the main fuel injection nozzle 7A with respect of the direction in which the air flows, a distance available for premixing is short. Therefore, the fuel F jetted out through the local fuel injection port 19*a* creates a local combustible fuel mixture zone before the fuel F is mixed into the compressed air A to produce a lean fuel mixture. The combustible fuel mixture thus produced flows through the premixing passage 24 into the combustion chamber 3*a*.

Figure 5:
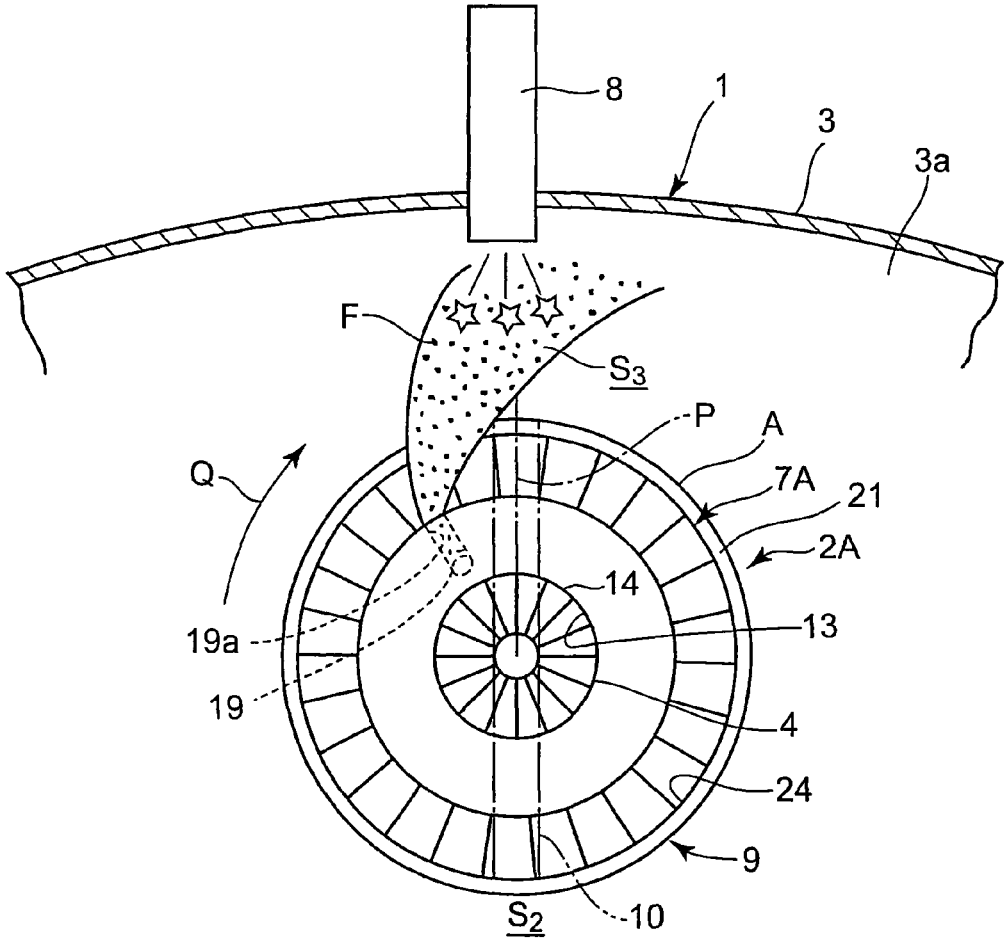
FIG. 5 is a rear view taken in the direction of the arrow V in FIG. 2.

FIG. 5 is a rear view taken in the direction of the arrow V in FIG. 2. As obvious from FIG. 5, the combustible fuel mixture flows together with the swirling compressed air passed through the swirlers 21 to form a local combustible fuel mixture zone S3 extending toward a space in the vicinity of the igniter 8, toward the tip of the igniter 8 in this embodiment. The local fuel injection port 19*a* is at an angular position separated from an axis P aligned with the axis of the igniter 8 as viewed in FIG. 5 by an angle in a direction opposite the swirling direction of the swirling air indicated by the arrow Q in FIG. 5. Thus the combustible fuel mixture zone S3 is curved so as to extend toward the tip of the igniter 8 by the swirling air current. The main air layer S2 is formed in a region in which the combustible fuel mixture zone S3 shown in FIG. 2 is not formed. The local fuel injection port 19*a* is formed in the main fuel injection nozzle 7A at optimum axial and circumferential positions determined taking into consideration the flow of the swirling air current in the premixing passage 24 of the main fuel injection nozzle 7A and effect on preventing flash back and autoignition.

The combustible fuel mixture zone S3 is ignited by the energy of sparks discharged by the igniter 8 and burns to produce an initial flame. The initial flame propagates through the combustible fuel mixture zone S3. Upon the spread of the flame to the inner pilot combustible fuel mixture zone S1 shown in FIG. 2, the pilot combustible fuel mixture zone S1 ignites. The pilot combustion fuel mixture zone S1 is formed by the mixing of the fuel F and the compressed air A in the combustion chamber 3*a*. Therefore, the pilot combustible fuel mixture zone S1 is a zone in which the fuel F and the compressed air A are mixed irregularly. The pilot combustible fuel mixture zone S1 has parts having high fuel concentration and parts having low fuel concentration. Parts having a high fuel concentration ignite rapidly, easily and surely. Thus the ignition of the fuel mixture produced by the ignition fuel nozzle 2A is completed.

Whereas the fuel F is supplied only to the pilot fuel injection nozzle 4 of the normal fuel nozzle 2B shown in FIG. 3, part of the fuel F supplied to the pilot fuel injection nozzle 4 of the ignition fuel nozzle 2A shown in FIG. 2 is supplied through the local fuel supply passage 19 to the local fuel injection port 19*a* to inject the fuel F into a space in the vicinity of the exit of the premixing passage 24 to create the local combustible fuel mixture zone S3 in the main air layer S2 that obstruct ignition, during an operation in a low-output mode, particularly, during a starting ignition operation, so that the fuel mixture of the pilot combustible fuel mixture zone S1 may be surely ignited through the local combustible fuel mixture zone S3. The local fuel supply passage 19 may be individually formed in the stem 10 instead of being connected to the fuel supply passage 11.

The normal fuel nozzle 2B shown in FIG. 3 is not provided with any passage corresponding to the local fuel supply passage 19 connected to the local fuel injection port 19*a* shown in FIG. 2. Therefore, the normal fuel nozzle 2B forms the pilot combustible fuel mixture zone S1 and the main air layer S2 covering the pilot combustible fuel mixture zone S1, but does not form any zone corresponding to the combustible fuel mixture zone S3. However, flames of the burning combustible fuel mixtures from the two ignition fuel nozzles 2A propagate successively through the pilot combustible fuel mixture zones S1 (FIG. 3) created by the fuel jetted out through the pilot fuel injection nozzles 4 of the normal fuel nozzles 2B and, consequently, the fuel mixtures produced by mixing the fuel jetted out by all the fuel nozzles 2A and 2B with air are ignited. Reignition after blow off is accomplished by the same process as the starting ignition process.

The fuel controller 29 shown in FIG. 4 opens the necessary three-way solenoid valves during operations in a middle- and a high-output mode to supply the fuel F to the main fuel injection nozzles 7A and 7B in addition to supplying the fuel F to the supply passages 11 connected to the pilot fuel injection nozzles 4. Then, the fuel F flows through the fuel supply passages 17 and 18 shown in FIGS. 2 and 3 and is injected through the normal fuel injection ports 18*a* into the premixing fuel passages 24. The fuel F is mixed satisfactorily with the swirling compressed air A caused to swirl by the swirlers 21 in a uniform, lean fuel mixture. The lean fuel mixture flows into the combustion chamber 3*a* for lean burn to reduce $NO_x$ emission.

Figure 6:
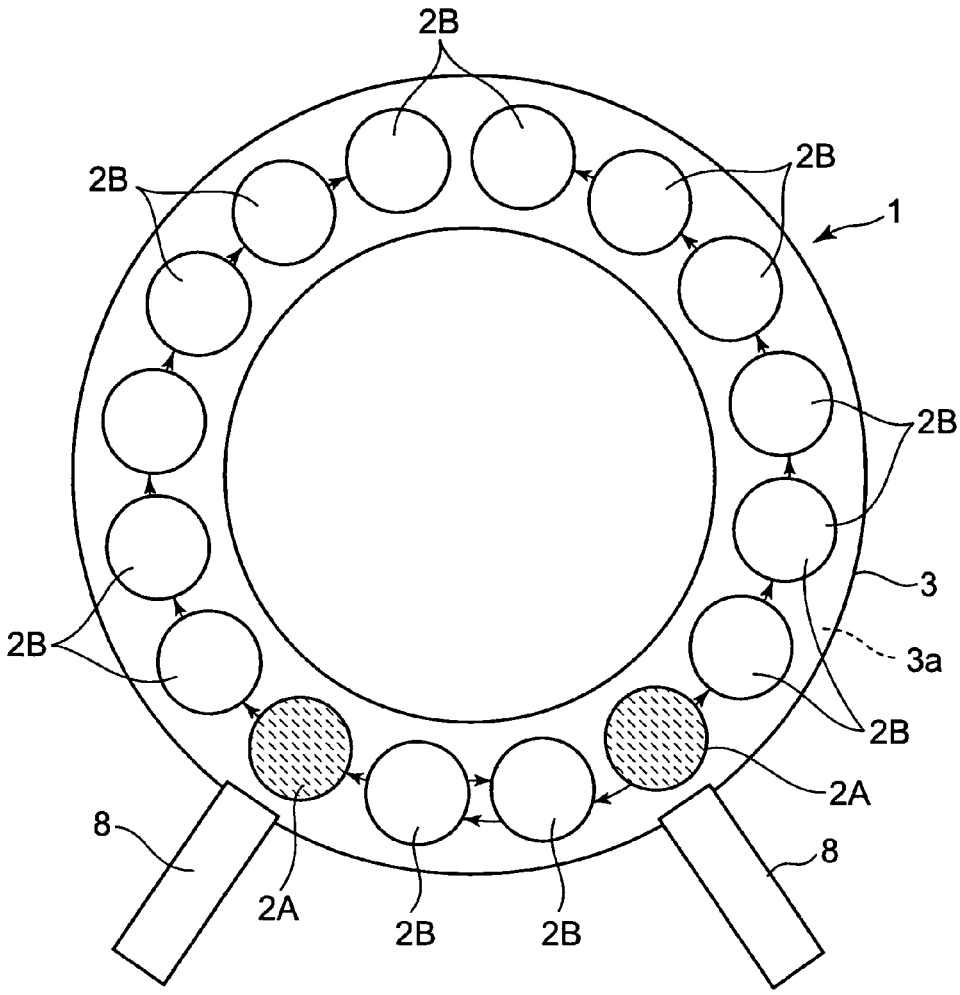
FIG. 6 is a schematic front view of assistance in explaining an ignition process to be carried out to start the gas turbine combustor in the first embodiment.

The hybrid ignition fuel nozzle 2A injects the fuel F through the local fuel injection port 19*a* into the premixing passage 24 during operations in all output modes. The fuel nozzle 2A indicates a fuel nozzle that is closest to the igniter 8 and that includes both fuel injection port 18*a* and local fuel injection port 19*a*, as shown in at least in FIGS. 1 and 2. Therefore, during operations in a middle- and a high-output mode, the fuel is injected locally into the uniformly mixed lean fuel mixture and, consequently, $NO_x$ emission increases. Normally, the annular combustor of this type is provided with twelve to thirty fuel nozzles 2A and 2B. The fuel nozzle 2B indicates a fuel nozzle not closest to the igniter 8, and that does not include local fuel injection port 19*a*, as shown in at least FIGS. 3 and 6. Since the small number of fuel nozzles 2A corresponding to the igniters, i.e., the two fuel nozzles 2A in FIG. 1 are used for ignition, the amount of the fuel injected locally into the combustion chamber 3 is very small and such a small amount of fuel increases $NO_x$ emission scarcely. If even such a very small amount of the fuel is not permissible, a more uniform fuel mixture can be produced by taking into consideration the fuel jetting rate at which the fuel is jetted out through the local fuel injection ports 19*a* and arranging the normal fuel injection ports 18*a* at unequal angular intervals. Therefore, the low-$NO_x$ characteristic, which is an original characteristic of the hybrid fuel nozzle, can be maintained and the ignition characteristic, which has been a potential disadvantage of the lean premixed combustor, can be remarkably improved by using an ignition performance improving mechanism including the local fuel injection ports 19*a* of this embodiment. During operations in a middle- and a high-output mode, the injection of the fuel F through the pilot fuel injection nozzles 4 and the local fuel injection ports 19*a* may be stopped.

The combustor 1 can be formed only by modifying the normal fuel nozzles 2B shown in FIG. 3 of a conventional combustor to form ignition fuel nozzles identical with the ignition fuel nozzle 2A provided with the local fuel injection port 19*a* shown in FIG. 2 or only by replacing the normal fuel nozzles 2B with the ignition fuel nozzles 2A. Thus the mechanical interface of the engine does not need to be changed and the fuel system and the ignition system do not need to be changed. Consequently, time for developing the combustor can be reduced, the combustor can be produced efficiently at a low cost and the ignition performance can be improved.

Figure 7:
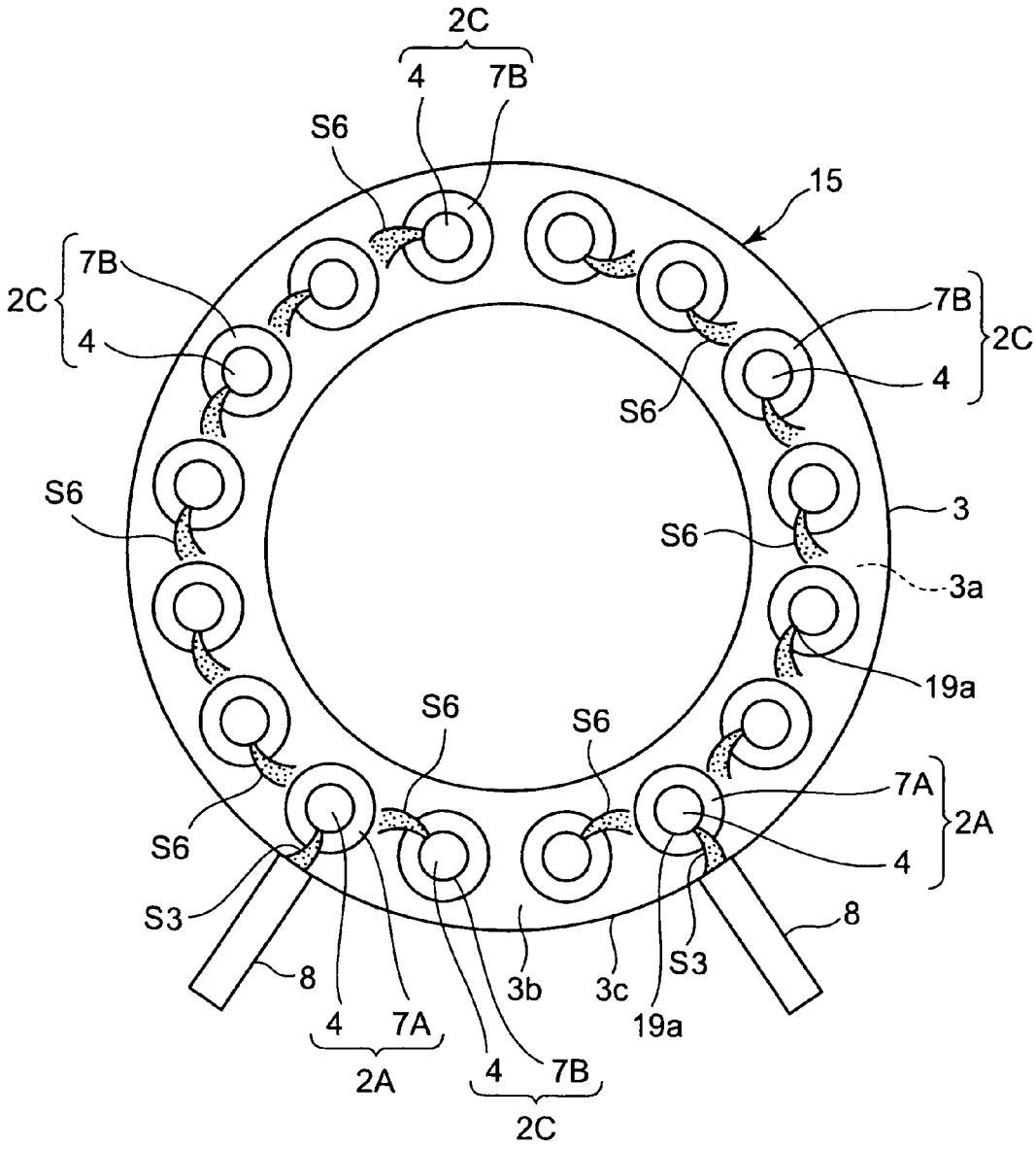
FIG. 7 is a schematic front view of assistance in explaining a starting ignition process to be carried out by a head unit included in a gas turbine combustor 15 in a second embodiment according to the present invention.

FIG. 7 is a schematic front view of assistance in explaining a starting ignition process to be carried out by a head unit included in a gas turbine combustor 15 in a second embodiment according to the present invention. In the gas turbine combustor 15, an ignition improving mechanism including the local fuel supply passage 19 and the local fuel injection port 19*a* shown in FIG. 2 is incorporated into all fuel injection nozzles 2C in addition to incorporating the same into ignition fuel nozzles 2A respectively disposed close to igniters 8 similarly to those of the first embodiment. The fuel injection nozzle 2C indicates a fuel nozzle not closest to the igniter 8 and that has a local fuel injector port 19*a* as shown in at least FIG. 7. The position of the local fuel injection port 19*a* of each of the fuel nozzles 2C other than the ignition fuel nozzles 2A is determined such that a combustible fuel mixture produced by mixing the fuel F jetted out through the local fuel injection port 19*a* into part of the air A flowing through a premixing passage 24 flows a combustible fuel mixture zone S6 extending toward the adjacent normal fuel nozzle 2C on the side of the igniter 8 or toward the ignition fuel nozzle 2A. Thus the fuel mixture produced by the ignition fuel nozzle 2A can be surely ignited by the igniter 8 and, at the same time, flames spreads rapidly and surely to the fuel mixtures produced by the normal fuel nozzles 2C.

Figure 8:
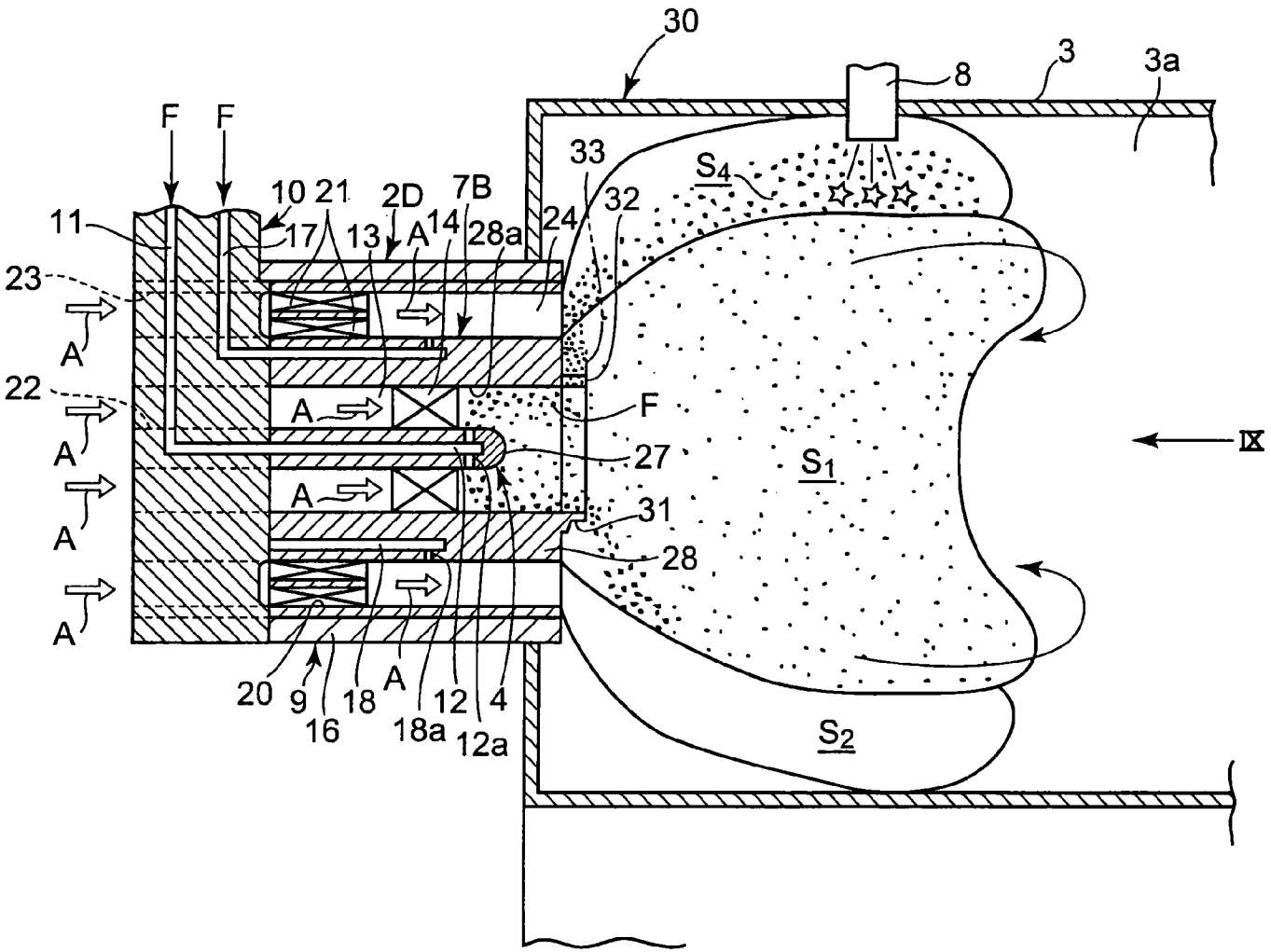
FIG. 8 is a longitudinal sectional view of a gas turbine combustor in a third embodiment according to the present invention.
Figure 9:
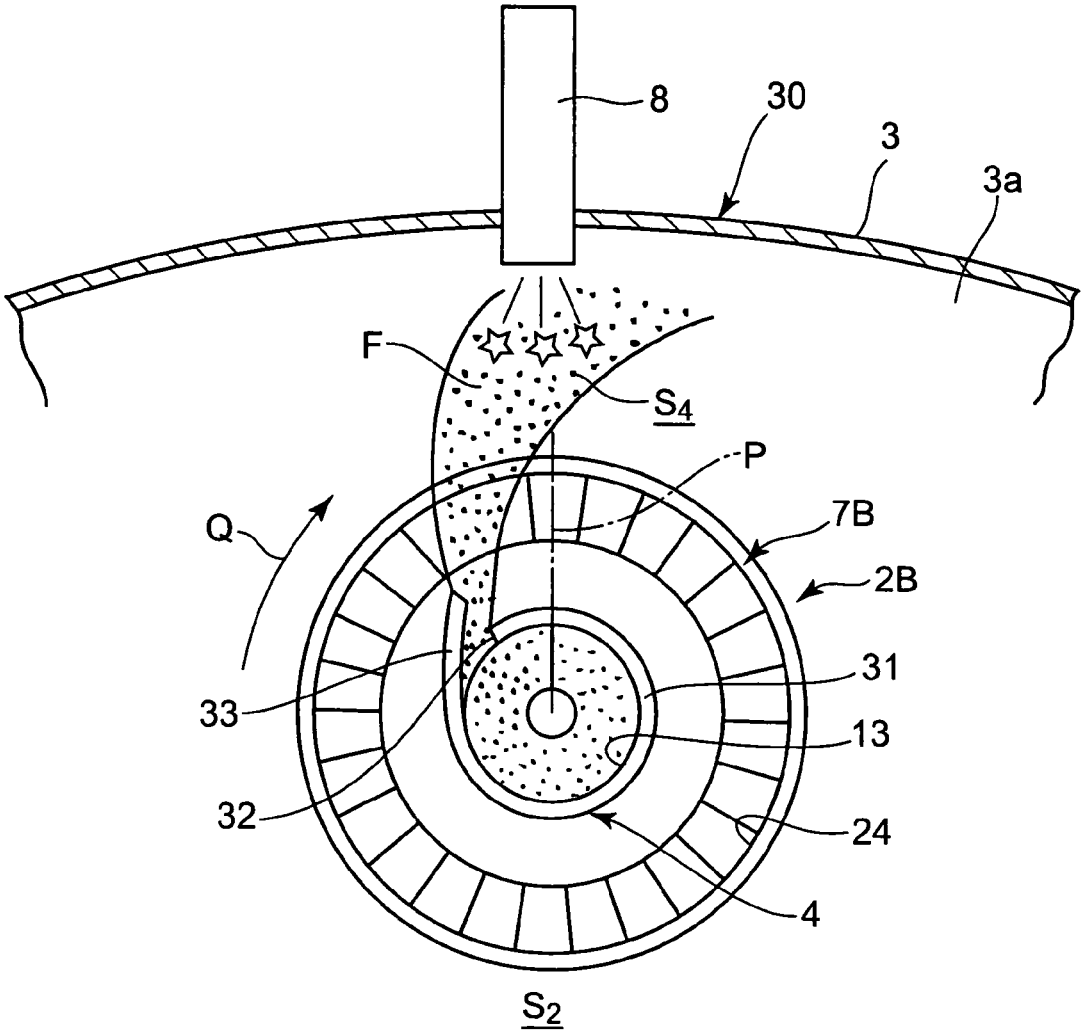
FIG. 9 is a rear view taken in the direction of the arrow IX in FIG. 8.

FIG. 8 is a longitudinal sectional view of a gas turbine combustor 30 in a third embodiment according to the present invention and FIG. 9 is a rear view taken in the direction of the arrow IX in FIG. 8, in which parts like or corresponding to those shown in FIGS. 2 and 5 are designated by the same reference characters and the description thereof will be omitted to avoid duplication. A fuel nozzle 2D included in the combustor 30 shown in FIG. 8 is different from the ignition fuel nozzle 2A shown in FIG. 2 because fuel nozzle 2D is not provided with the fuel supply passage 19 or the local fuel injection port 19*a* and is basically similar to the normal fuel nozzle 2B shown in FIG. 3 and having the pilot fuel injection 4 and the main fuel injection nozzle 7B. The fuel injection nozzle 2D indicates a fuel nozzle that is closest to the igniter 8 and does not have a local fuel injection port 19*a* as shown in at least FIG. 8. The fuel nozzle 2D has a pilot fuel injection nozzle 4 and an annular air duct 13. As shown in FIG. 8, the annular air duct 13 is provided with a substantially annular projection 31 projecting downstream into a combustion chamber 3*a*. As shown in FIG. 9, the projection 31 has an opening 32 and a guide part 33. The opening 32 and the guide part 33 are positioned and shaped so that the fuel F passed through the annular air duct 13 flows toward an igniter. The combustor 30 is similar in other respects to the combustor 1 in the first embodiment.

Operations of the gas turbine combustor 30 will be described. When the combustor 30 is in a starting ignition operation or in an operation in a low-output mode, the fuel controller 29 shown in FIG. 4 controls the fuel regulator 26 to supply the fuel F only to the fuel supply passage 11 connected to the pilot fuel injection nozzle 4 of each fuel nozzle 2D. When the combustor 30 is in an operation in a middle- or a high-output mode, the fuel is supplied to both the fuel supply passage 11 and a fuel supply passage 17 connected to the main fuel injection nozzle 7B. As shown in FIG. 8, a downstream end part of a fuel supply passage 12 formed in the pilot fuel injection nozzle 4 is connected to plural fuel injection ports 12*a* arranged at angular intervals. The fuel F is sprayed through the fuel injection ports 12*a* in a wide angular range. Part of the fuel F sprayed through the fuel injection ports 12*a* into a space surrounded by the annular air duct 13 adheres to the inside surface 28*a* of a partition wall 28 forming the annular air duct 13. Most part of the fuel F sprayed through the fuel injection ports 12*a* into a space surrounded by the annular air duct 13 is dispersed by swirling compressed air A passed through a swirler 14 and flows together with the swirling compressed air A into the combustion chamber 3*a* and creates a pilot combustible fuel mixture zone S1 in the combustion chamber 3*a*. The pilot combustible fuel mixture zone S1 is covered with a main air layer S2 of the compressed air A flowing through an annular air duct 20 included in the main fuel injection nozzle 7B and a premixing passage 24 into the combustion chamber 3*a*.

The fuel F adhered to the inside surface 28*a* of the partition wall 28 is forced to flow downstream along the inside surface 28*a* by the pilot compressed air A flowing through the annular duct 13. Most part of the fuel F reached the downstream end of the annular air duct 13 separates from the projection 31 and is mixed into the compressed air A to form a part of the pilot combustible fuel mixture zone S1. The rest of the fuel F reached the opening 32 of the projection 31 flows along the inside surface 28*a* and past the opening 32 in a radially outward direction, comes into contact with the compressed air A flowed through the premixing passage 24 of the main fuel injection nozzle 7B into the combustion chamber 31 and is mixed with part of the compressed air A to produce a combustible fuel mixture.

The combustible fuel mixture is borne on the swirling currents of the compressed air A toward the igniter 8 and, consequently, a combustible fuel mixture zone S4 locally extending toward the tip of the igniter 8 is created. The opening 32 is at an angular position separated from an axis P aligned with the axis of the igniter 8 as viewed in FIG. 9 by an angle in a direction opposite the swirling direction of the swirling air currents indicated by the arrow Q in FIG. 9. The guide part 33 covers the edge of the opening 32 farther from the axis P. Thus the combustible fuel mixture zone S4 is curved so as to extend toward the tip of the igniter 8. An ignition process to be executed after the combustible fuel mixture zone S4 has been created is the same as that mentioned in connection with the description of the first embodiment and hence the description thereof will be omitted.

The combustor 30 in the third embodiment, similarly to the combustor 1 in the first embodiment, creates the combustible fuel mixture zone S4 extending toward the tip of the igniter 8 by using part of the fuel F continuously supplied to the pilot fuel injection nozzle 4 shown in FIG. 8 during a starting ignition operation or a reignition operation to ignite the fuel mixture forming the pilot combustible fuel mixture zone S1 with reliability. Consequently, ignition performance can be improved. A lean fuel mixture supplied by the main fuel injection nozzle 7B during an operation in a middle- or high-output mode achieves low-$NO_x$ combustion.

The fuel nozzle 2D of the combustor 30 can be formed simply by incorporating an improvement including forming the projection 31 having the opening 32 and the guide part 33 on the downstream end of the annular air duct 13 of the pilot fuel injection nozzle 4 to the existing normal fuel nozzle 2B shown in FIG. 3. The improvement needs to be incorporated into only the two fuel nozzles disposed close to the tips of the igniters, respectively, and hence the improvement does not cause a significant increase in the cost. Whereas the combustor 1 in the first embodiment jets out the fuel F through the local fuel injection port 19 (FIG. 2) of the main fuel injection nozzle 7A during operations in all output modes, the combustor 30 in the third embodiment delivers the fuel F only through the premixing passage 24 of the main fuel injection nozzle 7B during operations in a middle- and a high-output mode to avoid increasing $NO_x$ emission.

Figure 10:
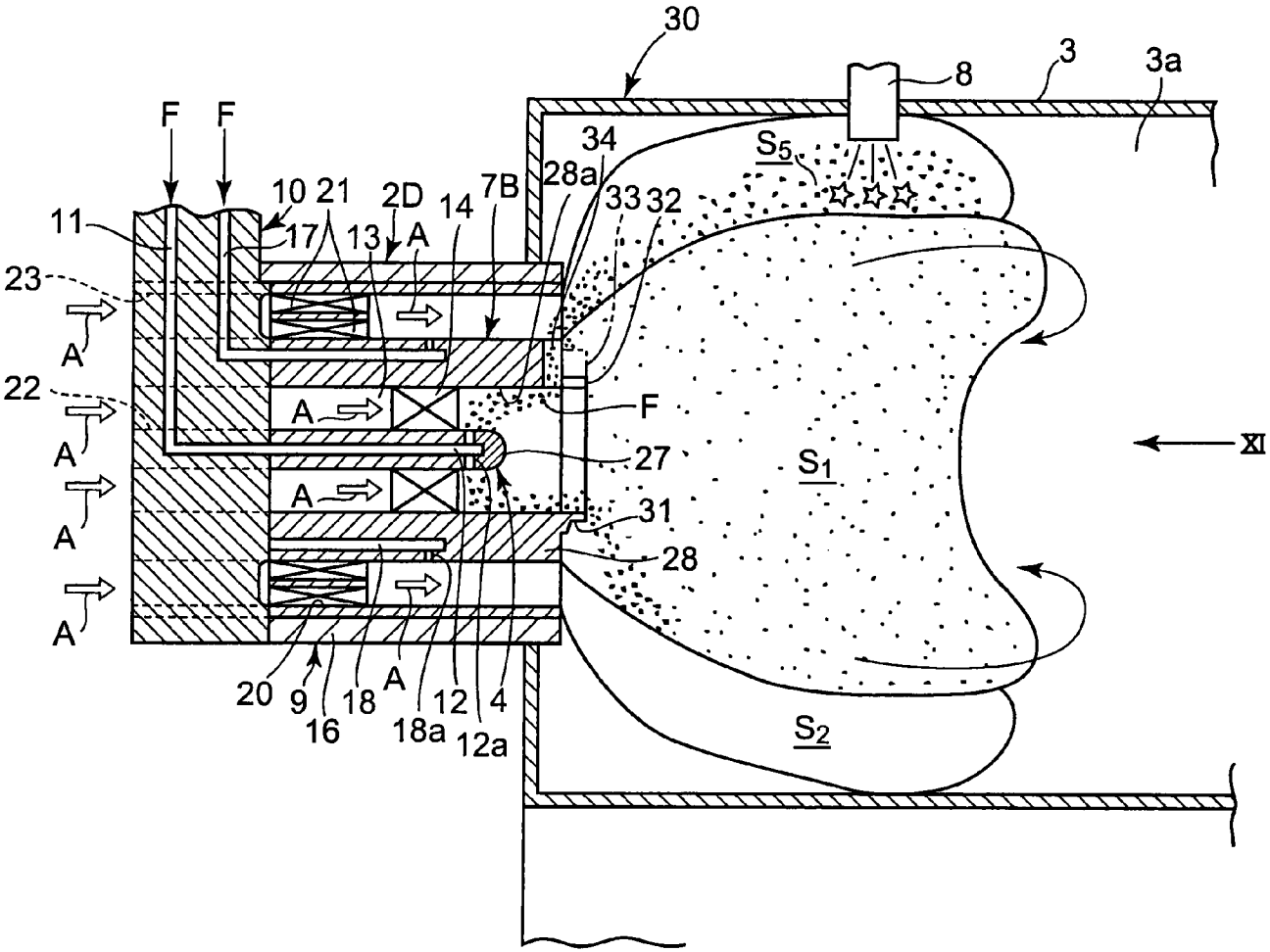
FIG. 10 is a longitudinal sectional view of a gas turbine combustor in a fourth embodiment according to the present invention.
Figure 11:
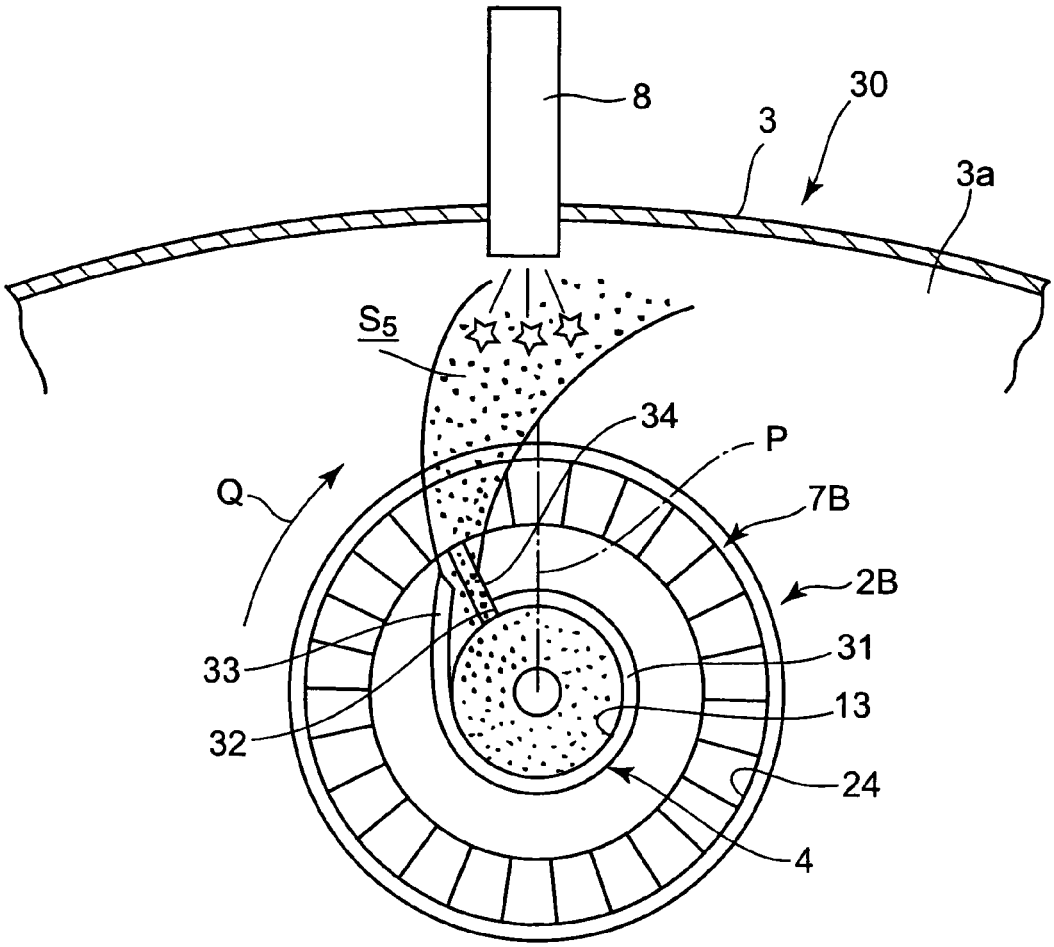
FIG. 11 is a rear view taken in the direction of the arrow XI in FIG. 10.

FIG. 10 is a sectional view of a gas turbine combustor 30 in a fourth embodiment according to the present invention and FIG. 11 is a rear view taken in the direction of the arrow XI in FIG. 10, in which parts like or corresponding to those shown in FIGS. 8 and 9 are designated by the same reference characters and the description thereof will be omitted to avoid duplication. In the combustor 30 shown in FIG. 10, a guide groove 34 for guiding the fuel F toward an igniter 8 is formed in a downstream end part of an annular air duct 13 included in a pilot fuel injection nozzle 4 shown in FIG. 10 similar to that of the third embodiment so as to be continuous with an opening 32 shown in FIG. 11 corresponding to the foregoing opening 32.

The combustor 30 in the fourth embodiment has, in addition to those of the third embodiment, an effect on suppressing the circumferential dispersion of the fuel F reached the opening 32 formed in a projection 31 and delivered through the opening 32 by guiding the fuel F by the guide groove 34 in a diametrical direction. Thus a combustible fuel mixture S5 of a fuel mixture richer than that formed by the combustor in the third embodiment can be created.

Figure 12:
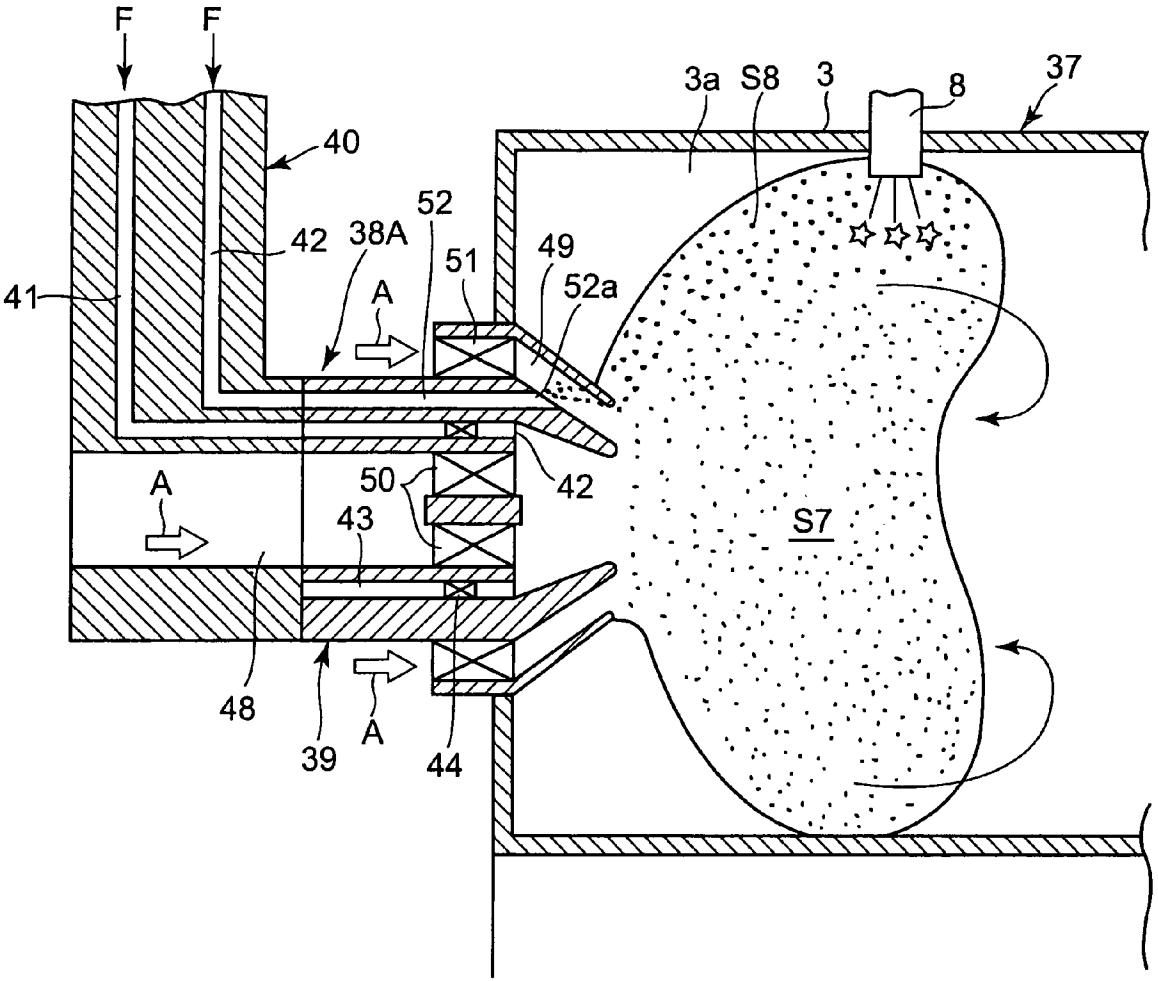
FIG. 12 is a longitudinal sectional view of a part around an igniter of a gas turbine combustor in a fifth embodiment according to the present invention.
Figure 13:
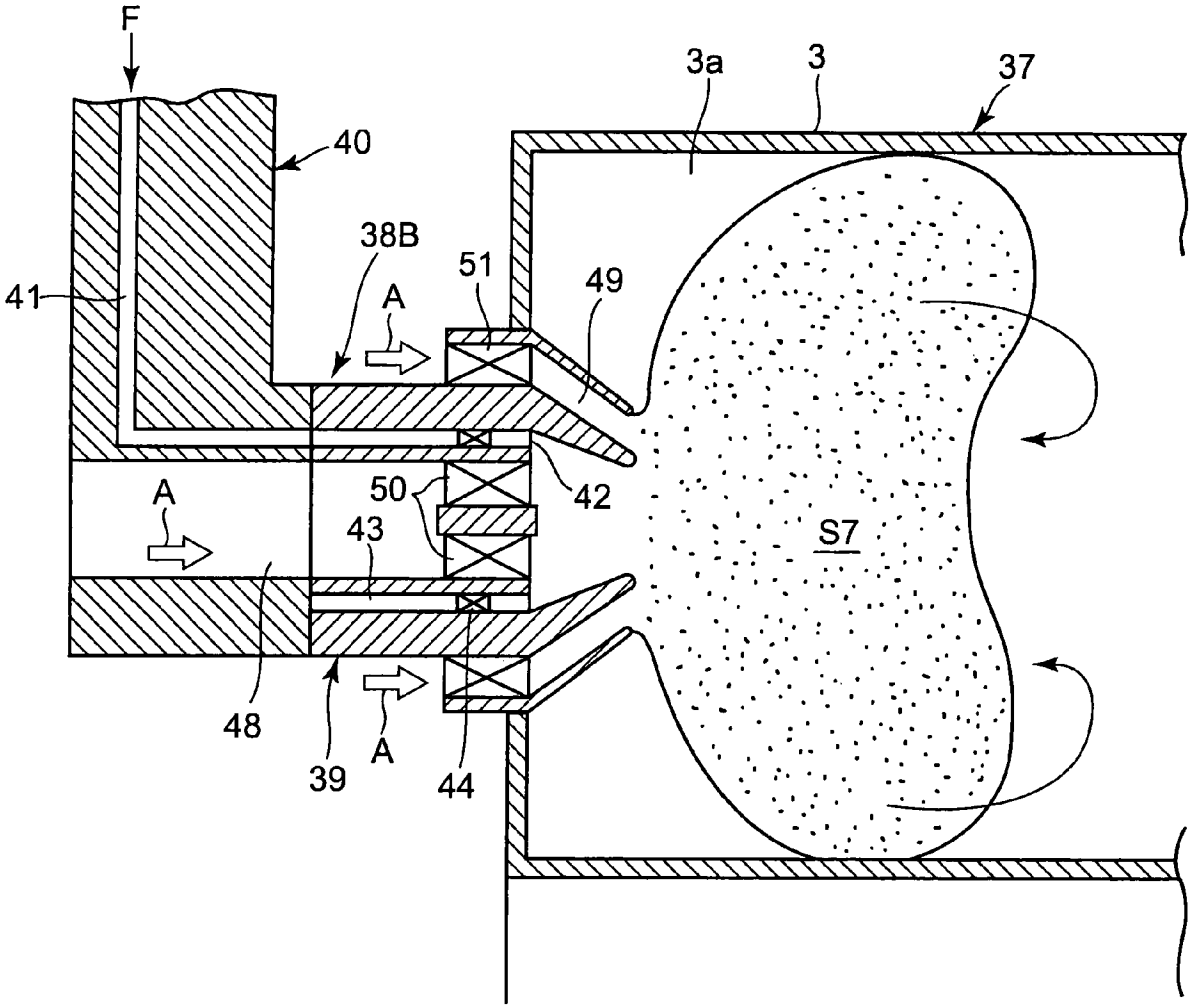
FIG. 13 is a longitudinal sectional view of a part apart from the igniter of the gas turbine combustor in the fifth embodiment.

FIG. 12 is a longitudinal sectional view of a part around an igniter 8 of a gas turbine combustor 37 in a fifth embodiment according to the present invention and FIG. 13 is a longitudinal sectional view of a part apart from the igniter 8 of the gas turbine combustor 37 in the fifth embodiment. The combustor 37 in the fifth embodiment is provided with fuel nozzles 38A and 38B different from the hybrid fuel nozzles 2A and 28 employed in the first to the fourth embodiment. The fuel controller 29 shown in FIG. 4 does not execute the staging control of the fuel nozzles 38A and 38B of the gas turbine combustor 37; that is, the fuel nozzles 38A and 38B have a normal fuel injection unit not discriminating between a pilot fuel injection valve and a main fuel injection nozzle.

The combustor 37 in the fifth embodiment has, similarly to the combustor 1 in the first embodiment, a combustor 3 defining a combustion chamber 3*a*. Plural ignition fuel nozzles 38A and plural normal fuel nozzles 38B are disposed in a circumferential arrangement at equal angular intervals in the combustion chamber 3*a*. FIG. 12 shows the ignition fuel nozzle 38A disposed close to an igniter 8. The ignition fuel nozzle 38A exercises an ignition operation. FIG. 13 shows the normal fuel nozzle 38B disposed apart from the igniter 8.

The ignition fuel nozzle 38A shown in FIG. 12 has a nozzle body 39, and a stem 40 holding the nozzle body 39 on a combustor housing (outer cylinder), not shown. The stem 40 is provided with a fuel supply passage 41 and a local fuel supply passage 42. The fuel F is supplied into the passages 41 and 42 from an external fuel source. The combustor 37 is provided with a main air passage 48 extending from a position beside the stem 40 through a central part of the nozzle body 39 and opening into the combustion chamber 3*a*, and an auxiliary air passage 49 surrounding the nozzle body 39. Part of compressed air A supplied to the ignition fuel nozzle 38A flows through the auxiliary air passage 49. Swirlers 50 and 51 for swirling air currents are disposed in the main air passage 48 and the auxiliary air passage 49, respectively. The fuel F is supplied through the fuel supply passage 41 into a fuel supply passage 43 surrounding the main air passage 48 and provided with a swirler 44. The fuel F caused to swirl by the swirler 44. The swirling fuel F is injected through a normal fuel injection port 47 into the combustion chamber 3*a*. The nozzle body 39 is provided with a local fuel supply passage 52 in a part on the outer side of the fuel supply passage 43 and on the side of the igniter 8.

The fuel F is injected through the fuel injection port 47 surrounding the main air passage 48 into the combustion chamber 3*a* in a thin fuel film. The fuel F injected through the fuel injection port 47 into the combustion chamber 3*a* is mixed uniformly into the swirling air A caused to swirl by the swirlers 50 and 51 to crate a combustible fuel mixture zone S7 in the combustion chamber 3*a*. The fuel F supplied through the fuel supply passage 42 of the stem 40 flows into the local fuel supply passage 52 and is injected through a local fuel injection port 52*a* at the exit of the local fuel supply passage 52 into the auxiliary air passage 49. The fuel F injected into the auxiliary air passage 49 is missed into the swirling air A caused to swirl by the swirler 51 to create a local rich combustible fuel mixture zone S8 in the combustible fuel mixture zone S7. The rich combustible fuel mixture zone S8 extends from the auxiliary air passage 49 to a region in the vicinity of the igniter 8, a region around the tip of the igniter in this embodiment. the position of the local fuel injection port 52*a* is determined such that the combustible fuel mixture zone S8 formed by the fuel F jetted out through the local fuel injection port 52*a* and the air A flowed through the swirler 51 can reach the tip of the igniter 8.

The normal fuel nozzle 38B shown in FIG. 13 is substantially similar in construction to the ignition fuel nozzle 38A, except that the normal fuel nozzle 38B is not provided with any passages corresponding to the local fuel supply passage 42 and 52 of the ignition fuel nozzle 38A.

Operations of the gas turbine combustor 37 will be described. Referring to FIGS. 12 and 13, the fuel F is supplied into the fuel supply passages 41 of the fuel nozzles 38A and 38B when the gas turbine combustor 37 is in a starting ignition operation to create the combustible fuel mixture zone S7. At the same time, the fuel F is supplied into the local fuel supply passage 42 of the ignition fuel nozzle 38A shown in FIG. 12 to create the local rich combustible fuel mixture zone S8 in addition to the combustible fuel mixture zone S7.

The local rich combustible fuel mixture zone S8 can be easily ignited by the igniter 8 and burns to produce a pilot flame. The pilot flame propagates through the combustible fuel mixture zone S8. Upon the spread of the flame to the combustible fuel mixture zone S7, the combustible fuel mixture zone S7 ignites. Thus the ignition of the combustible fuel mixture produced by the ignition fuel nozzle 38A is accomplished. Whereas the fuel F is supplied only into the fuel supply passage 41 of the normal fuel nozzle 38B shown in FIG. 13 during operations in all output modes, the ignition fuel nozzle 38A shown in FIG. 12 injects the fuel F additionally through the local fuel injection port 52*a* into the auxiliary air passage 42 to create the local rich combustible fuel mixture zone S8 in the vicinity of the igniter 8. The combustible fuel mixture of the combustible fuel mixture zone S7 is ignited by the pilot flame produced by burning the combustible fuel mixture of the local rich combustible fuel mixture zone S8. After the combustible fuel mixture produced by the ignition fuel nozzle 38A has been ignited to produce the pilot frame, the pilot flame ignites the combustible fuel mixture of the combustible fuel mixture zone S7 produced by the adjacent normal fuel nozzle 38B. Thus flames propagate successively through the combustible fuel mixture zones S7 produced by the successively arranged normal fuel nozzles 38B and, eventually, the fuel F jetted by all the fuel nozzles 38A and 38B is ignited. Reignition after blow off is accomplished by the same process as the starting ignition process.

Normally, the combustor 37 is provided with ten to thirty fuel nozzles 38A and 38B in the annular combustion chamber 3*a*. Since the small number of ignition fuel nozzles 38A, namely, one or two ignition fuel nozzles, are disposed close to the igniters 8, respectively, for ignition, the amount of the fuel jetted out through the local fuel injection ports 52*a* is very small. When it is desired to improve the ignition performance of the existing combustor of this type without many modifications, the combustion characteristic of the combustor can be maintained and the ignition characteristic of the combustor can be improved by applying the ignition performance improving mechanism of the present invention only to the fuel nozzles disposed close to the igniters. The ignition performance can be improved simply by modifying the generally used normal fuel nozzle 38B to form the ignition fuel nozzle 38A provided with the ignition fuel supply passage 52 having the ignition fuel injection port 52*a* and shown in FIG. 12 or by replacing the normal fuel nozzle 38B with the ignition fuel nozzle 38A. Therefore, the interface of the engine fuel system does not need to be changed, time for developing the combustor can be reduced, and the combustor can be produced efficiently at a low cost.

The present invention has been described as applied to the annular type combustors in the foregoing embodiments each provided with the plural fuel nozzles disposed in the annular combustion chamber 3*a* of the combustor 3 in a circumferential arrangement. The present invention is applicable also to a single-cylinder type combustor disposed so as to project from a gas turbine in a substantially diametrical direction. The single-cylinder type combustor can exercise the same effects as those mentioned above when the single-cylinder combustor is capable of creating a combustible fuel mixture zone in the vicinity of an igniter.

The invention claimed is:

1. A gas turbine combustor comprising one or plural fuel nozzles each having a pilot fuel injection nozzle working for diffusion combustion only during an operation in a low-output operation mode including an ignition operation, and a main fuel injection nozzle working for premixed combustion during operation in a middle- and a high-output operation mode and surrounding the pilot fuel injection nozzle, wherein the one or plural fuel nozzles is provided with a normal fuel injection port for jetting out fuel from a predetermined position in a premixing passage in the main fuel injection nozzle to create a combustible fuel mixture zone, the pilot fuel injection nozzle including a duct forming a central fuel/air passage in fluid communication with a fuel supply passage of the pilot fuel injection nozzle and having an outlet at a downstream end, the normal fuel injection port is in fluid communication with a fuel supply passage which is in fluid communication with a fuel supply passage of the main fuel injection nozzle, and a projection provided with a single opening in a radially outward direction toward an igniter is projected downstream from the downstream end of the duct included in the pilot fuel injection nozzle, the projection surrounding the outlet of the central passage and disposed close to the igniter to jet fuel from the central passage toward the igniter only during an operation in a low-output operation mode including an ignition operation.

2. The gas turbine combustor according to claim 1 further comprising an annular combustion chamber in the combustor, wherein the plural fuel nozzles are disposed in the combustion chamber in a circumferential arrangement.

3. The gas turbine combustor according to claim 1, wherein a guide groove for guiding fuel toward the igniter is formed in the downstream end part of the duct of the pilot fuel injection nozzle so as to be continuous with the opening.

* * * * *